US007165877B2

(12) United States Patent
Lang

(10) Patent No.: US 7,165,877 B2
(45) Date of Patent: Jan. 23, 2007

(54) SLURRY MIXING APPARATUS

(76) Inventor: Damian L. Lang, Route 1, Box 167-1a, Waterford, OH (US) 45786

( * ) Notice: Subject to any disclaimer, the term of this patent is extended or adjusted under 35 U.S.C. 154(b) by 100 days.

(21) Appl. No.: 10/449,470

(22) Filed: May 30, 2003

(65) Prior Publication Data

US 2004/0240310 A1 Dec. 2, 2004

(51) Int. Cl.
*B28C 7/16* (2006.01)
*B28C 5/00* (2006.01)

(52) U.S. Cl. ..... 366/26; 366/46

(58) Field of Classification Search ..... 366/45, 366/46, 1, 26, 47, 48
See application file for complete search history.

(56) References Cited

U.S. PATENT DOCUMENTS

| | | | | | |
|---|---|---|---|---|---|
| 1,023,724 | A | * | 4/1912 | Crandall | 366/46 |
| 1,460,571 | A | * | 7/1923 | Carey | 366/46 |
| 1,780,973 | A | * | 11/1930 | Graham et al. | 366/46 |
| 1,856,728 | A | * | 5/1932 | Robb | 366/45 |
| 2,815,195 | A | * | 12/1957 | Bolt | 366/26 |
| 3,100,064 | A | * | 8/1963 | Kacena | 366/26 |
| 3,198,495 | A | * | 8/1965 | Maxon, Jr. | 366/46 |
| 3,424,498 | A | * | 1/1969 | Maxon, Jr. | 366/46 |
| 3,713,544 | A | * | 1/1973 | Wallace et al. | 212/304 |
| 4,075,711 | A | * | 2/1978 | Hall | 366/64 |
| 4,268,174 | A | * | 5/1981 | Falardeau | 366/46 |
| 4,435,081 | A | * | 3/1984 | Del Fabbro | 366/18 |
| 4,441,820 | A | * | 4/1984 | Maxon, III | 366/46 |
| 4,823,852 | A | * | 4/1989 | Langford | 144/4.1 |
| 4,854,711 | A | * | 8/1989 | Hagan | 366/46 |
| 4,956,821 | A | * | 9/1990 | Fenelon | 366/26 |
| 5,268,591 | A | * | 12/1993 | Fujimoto | 307/9.1 |
| 5,415,323 | A | | 5/1995 | Fenelon | |
| 5,419,633 | A | * | 5/1995 | Lorenzetti et al. | 366/65 |
| 5,622,235 | A | * | 4/1997 | Merritt | 180/9.42 |
| 6,129,226 | A | * | 10/2000 | Donovan | 212/300 |
| 6,666,573 | B1 | * | 12/2003 | Grassi | 366/26 |
| 6,817,747 | B1 | * | 11/2004 | Preisser et al. | 366/38 |

OTHER PUBLICATIONS

Anchor Manufacturing Company; Series 400 Mixer; brochure; publication date unknown; Chicago, IL, 2 pages.
Anchor Manufacturing Co.; Wheel and Axle; web page; publication date unknown; Chicago, IL, 1 page.
Stone Construction Equipment, Inc.; Hydraulic Mixer Features in Detail; web page; publication date unknown; Honeoye, NY, 2 pages.

* cited by examiner

*Primary Examiner*—Tony G. Soohoo
(74) *Attorney, Agent, or Firm*—Jason H. Foster; Kremblas, Foster, Phillips & Pollick

(57) ABSTRACT

The invention is an apparatus for mixing fluent material. A hopper is pivotably mounted to a frame on a pivot axis that is substantially spaced from the axis of rotation of a mixing paddle. Because the pivot axis is substantially spaced from the axis of rotation, the mixer can be loaded by the operator at a low charge height and subsequently dumped at a higher dump height. Horizontally adjustable arms in combination with vertically adjustable legs provide for adjustability in length, width and height of the apparatus for stability when the hopper is fully dumped.

3 Claims, 6 Drawing Sheets

SLURRY MIXING APPARATUS

CROSS-REFERENCES TO RELATED APPLICATIONS (Not Applicable)

STATEMENT REGARDING FEDERALLY-SPONSORED RESEARCH AND DEVELOPMENT (Not Applicable)

REFERENCE TO AN APPENDIX (Not Applicable)

BACKGROUND OF THE INVENTION

1. Field of the Invention

This invention relates generally to an apparatus for mixing fluent material, including slurries, which are liquids mixed with particulate matter such as gravel, sand, dust, mortar and cement.

2. Description of the Related Art

On a typical construction site, mortar and/or concrete is utilized in different stages of the operation from laying block to pouring walls and sidewalks. Having an apparatus on site that mixes the fluent mortar or concrete slurry is essential. A mixing apparatus is used to mix the necessary ingredients to create the mortar or concrete mixture. The laborers fill the mixing apparatus with mortar or cement and sand and other essential ingredients, such as water, and the mixing blades mechanically stir the materials, thereby creating a slurry of water, dissolved chemicals and particulate. The slurry is then either poured into another apparatus for transport throughout the site or poured directly into the designated concrete form.

In conventional mixers, the charge height, which is the height at which the mixer is filled, and the dump height, which is the height at which the fluent material is dumped, are substantially different, and the charge height is higher than the dump height. For example, the Essick mixing device sold by Multiquip, Inc. of Carson, Calif., has a dump height that is substantially lower than the charge height. Having a dump height that is lower than the charge height may seem reasonable, but there are ergonomic disadvantages with this configuration. Conventional mixers having a higher charge height require an operator to lift bags of mortar or cement and shovel sand and gravel to chest height. The repetitive nature of this action may cause back strain, fatigue or injury to the operator, making him less effective and possibly causing delay at the job site.

It is also important in conventional mixers to maintain a low center of gravity for the apparatus during dumping so that the apparatus does not become unbalanced and tip over. The Multiquip, Inc.'s mixer maintains a low center of gravity by pivoting the hopper around the mixing paddle axis to pour its contents. The hopper is rotated and the lip of the hopper is gradually moved to a position below the upper surface of the contents of the hopper. There is not a significant change in the position of the center of gravity of this mixing apparatus because of the minimal or non-existent movement of the hopper's center of gravity relative to the paddle axis. The slender frame of the mixer can withstand this movement, and therefore it will not tip over.

Additionally, it is common to have a wheeled support frame on the mixer. This allows for towing of the mixing device to different job sites. The mixer produced by Multiquip, Inc., has two wheels at the rear of the device and a foot at the front. The wheels position the bottom of the drum higher above the ground for clearance when towing. This again raises the height at which the materials are to be installed (charge height).

There is also a greater risk of theft with a mixer that is wheeled, since any person could enter the job site and hitch the wheeled mixer to a vehicle and leave.

Therefore, there is a need for an improved mixing apparatus.

BRIEF SUMMARY OF THE INVENTION

The invention is a slurry mixing apparatus comprising a frame to which a hopper is pivotably mounted for receiving, mixing and dispensing a slurry material. The mixing apparatus preferably has two arms, each of which is mounted in a receiver on the frame, and each receiver permits substantially horizontal displacement of each respective arm relative to the frame. The apparatus preferably has four legs, two of which are mounted in a corresponding receiver on a respective one of the arms, and the third and fourth of which are mounted in receivers on the frame. The receiver of each leg permits substantially vertical displacement of the leg. Each leg terminates in a foot that seats against a surface upon which the apparatus rests. The arms, legs and feet form an adjustable support structure for the hopper and frame. It is contemplated that there may be only three legs and as few as one arm. However, two arms are preferred, even if there are only three legs.

The hopper has a chamber with an opening for receiving slurry material and is pivotably mounted to the frame on a pivot axis. A rotatable mixing paddle in the hopper chamber has an axis of rotation substantially spaced from the pivot axis. There is at least one linear prime mover mounted to the frame at a first prime mover end and to the hopper at an opposite, second prime mover end. The second prime mover end is spaced from the pivot axis to form a moment arm. The hopper is rotated about the pivot axis when the prime mover actuates. Thus, when the prime mover is actuated, the hopper rotates about the pivot axis and the hopper dumps at a height higher than it was filled. By having the pivot axis substantially spaced from the axis of rotation, the mixer can be loaded by the operator at a low charge height and subsequently dumped at a higher dump height.

In a preferred embodiment, the frame is substantially rectangular there are at least four legs and feet and two arms. Each arm is mounted at a different corner of the frame. The horizontally adjustable arms in combination with the vertically adjustable legs on the present invention provide for greater adjustability in the overall width and height of the apparatus. Thus, when dumping, any shift in weight does not tip the apparatus over. The frame also has built in pockets for a standard forklift.

Figure 1:
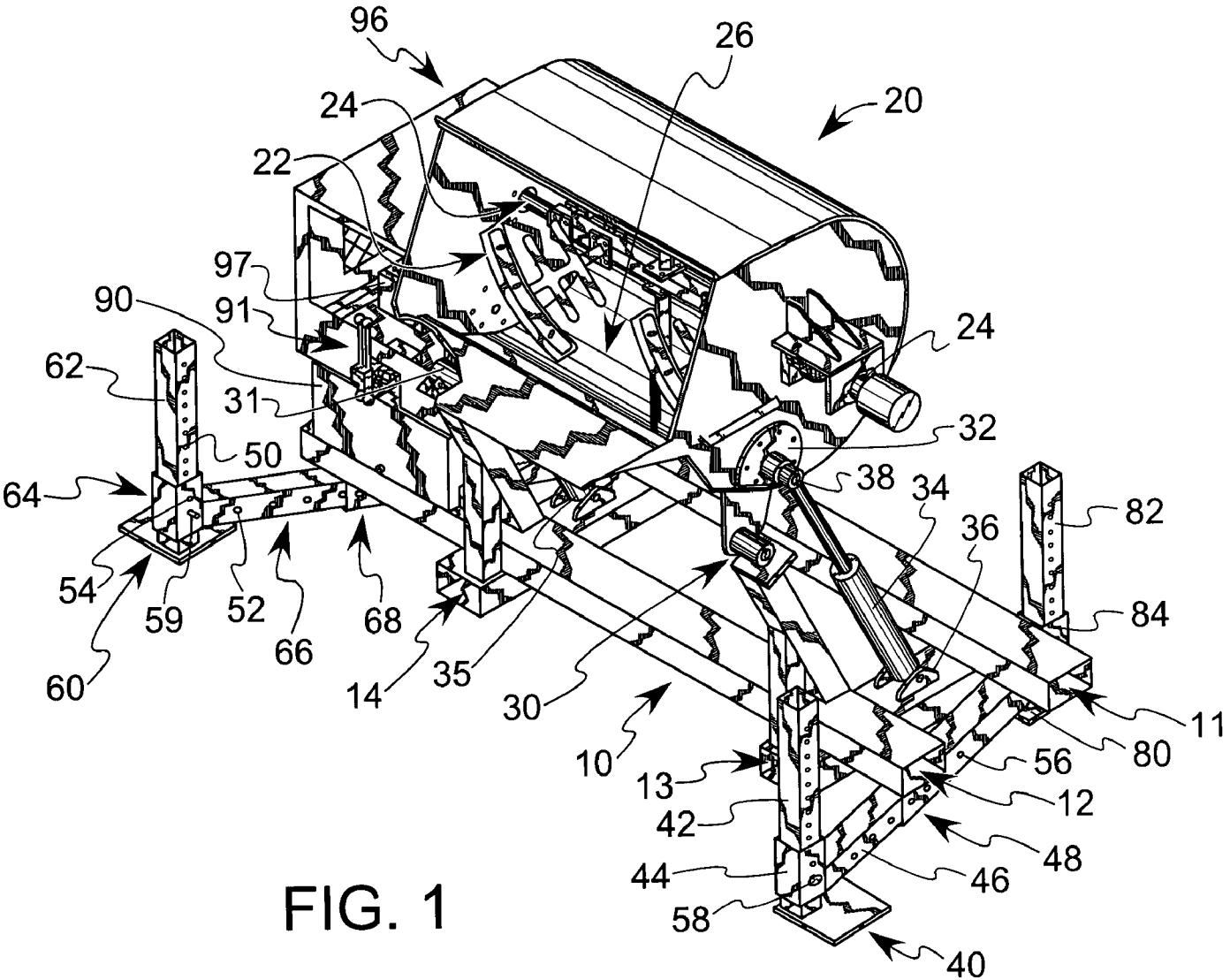
FIG. 1 is a view in perspective illustrating the preferred embodiment of the present invention.
Figure 2:
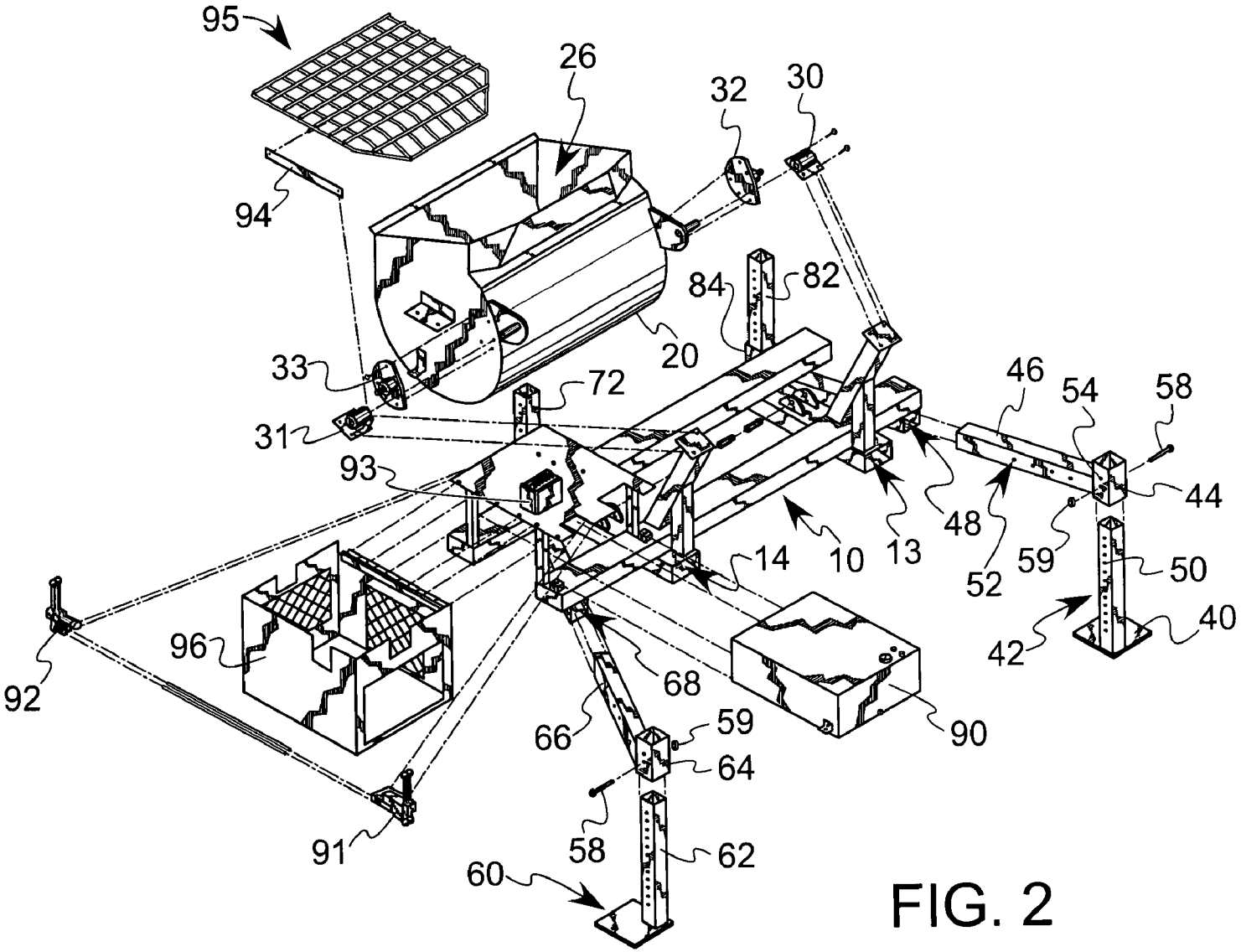
FIG. 2 is a view in perspective illustrating the preferred embodiment of the present invention.
Figure 3:
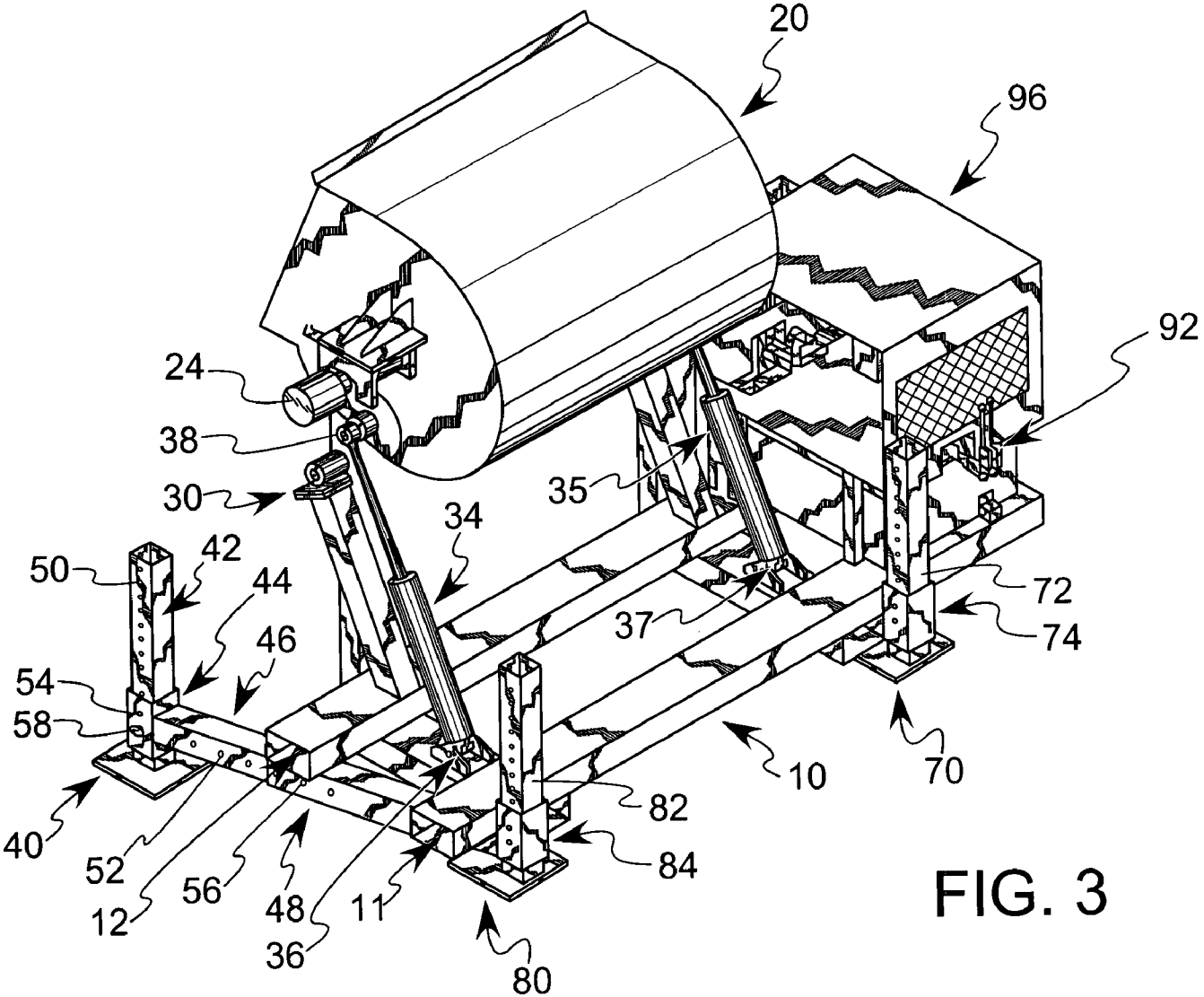
FIG. 3 is a rear view in perspective illustrating the preferred embodiment of the present invention.
Figure 4:
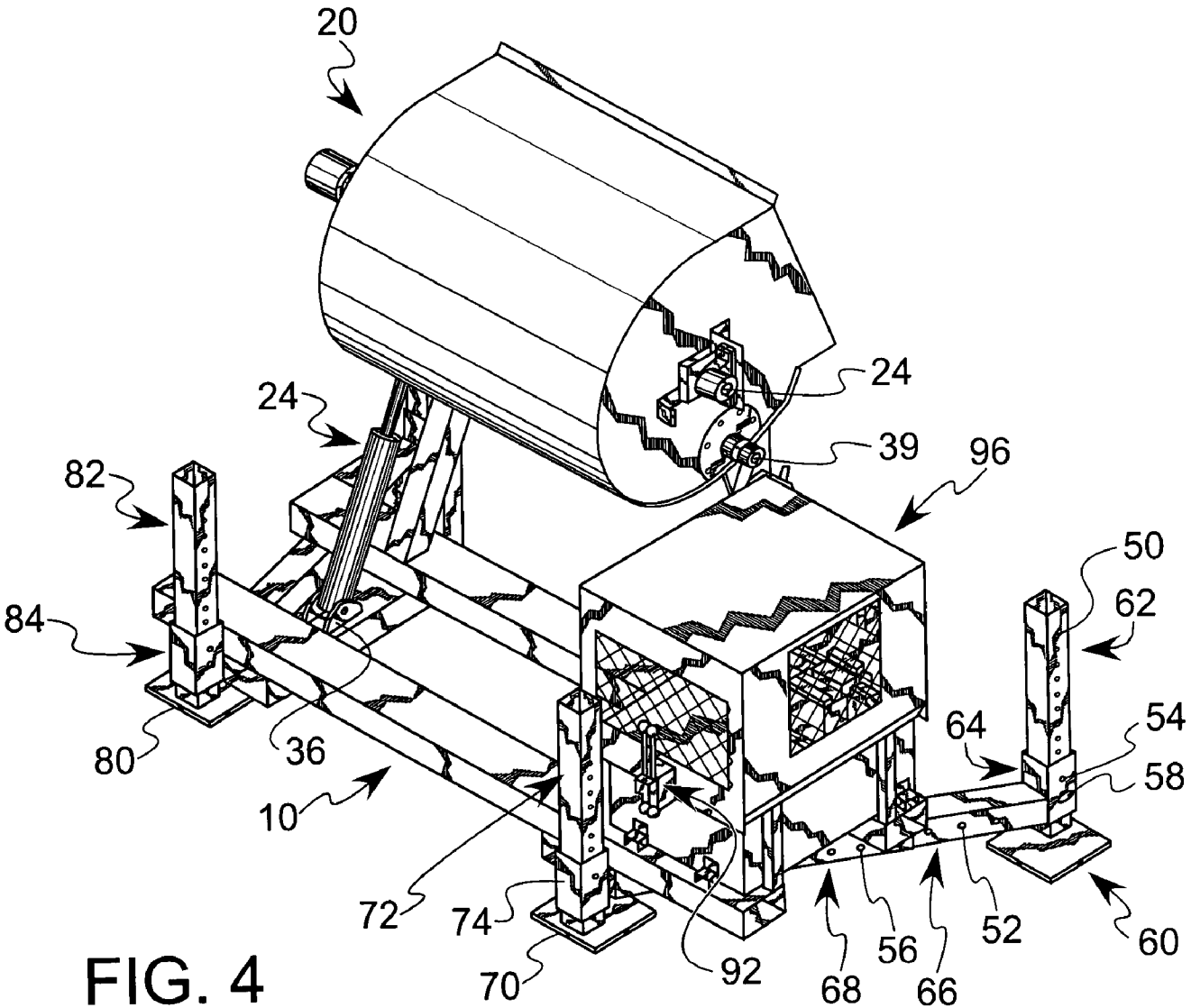
FIG. 4 is a rear view in perspective illustrating the preferred embodiment of the present invention.

In describing the preferred embodiment of the invention, which is illustrated in the drawings, specific terminology will be resorted to for the sake of clarity. However, it is not intended that the invention be limited to the specific terms so selected and it is to be understood that each specific term includes all technical equivalents, which operate in a similar manner to accomplish a similar purpose. For example, the word connected or terms similar thereto are often used. They are not limited to direct connection but include connection through other elements where such connection is recognized as being equivalent by those skilled in the art.

DETAILED DESCRIPTION OF THE INVENTION

The preferred embodiment of the present invention is shown in FIGS. 1 through 4. The hopper 20 is a conventional, barrel-like structure with a top opening to an inner chamber 26. The hopper 20 is pivotably mounted to the frame 10 by at least one pivot assembly 30. In the preferred embodiment there are two aligned pivot assemblies 30 and 31, which define the pivot axis of the hopper 20 and function as a hinge, and the pivot assembly 31 is visible through the cut away portion in FIG. 1. The frame 10 is the structural framework of rigid members to which the operational devices are attached.

Two upper prime mover mounts 32 and 33 are mounted to the hopper 20. The mounts 32 and 33 serve as mounting pins for the upper end of a prime mover. Preferably the linear prime movers 34 and 35 attach at their respective upper ends to the mounts 32 and 33. In particular, the prime mover 34 is mounted to the frame 10 at the lower prime mover end 36 and is mounted to the mount 32 at the upper prime mover end 38. The prime mover 35 is substantially identical to the prime mover 34, and attaches at its upper end to the mount 33, which is substantially coaxial with the mount 32.

The prime mover ends 38 and 39 are spaced substantially from the pivot assemblies 30 and 31 to form moment arms between the pivot assemblies 30 and 31 and the mounts 32 and 33. In the preferred embodiment, the prime mover 34 is a hydraulic ram. However, any other linear prime mover can be used.

When the prime movers 34 and 35 are extended longitudinally, an upwardly directed force is applied to the mounts 32 and 33 and the hopper 20 is pivoted away from the frame 10 as the hopper 20 hinges about the pivot axis extending through the pivot assemblies 30 and 31. This movement initiates dumping of the fluent material from the inner chamber 26 as the slurry is displaced over the lip of the hopper 20. During the dumping process, the center of gravity of the fluent material is shifted up and toward one side of the frame 10 as the hopper 20 is displaced eccentrically about the pivot axis. The hopper 20 is positioned at a dump height (shown in FIG. 1) that is higher than the charge height, thereby making the center of gravity of the hopper 20 higher and to one side of where it was in the lowered position.

When the prime movers 34 and 35 are actuated to shorten and move in the opposite direction, the hopper 20 pivots downwardly toward the lowered position where the hopper is at the charge height. The prime movers 34 and 35 can be elongated slowly or rapidly to a variety of lengths to satisfy the particular needs of the operator during use. In a preferred embodiment, the minimum charge height is approximately 39 inches with a minimum dump height of approximately 39½ inches when the legs and feet are extended fully downward as described below. In the preferred embodiment the maximum charge height is approximately 59 inches and the maximum dump height is approximately 59½ inches. Of course, these heights can be varied based upon preference as will become apparent from the description herein.

Within the inner chamber 26 of the hopper 20 is a rotatable mixing paddle 22 mounted to a drive shaft 24, which defines the axis of rotation of the mixing paddle 22. The axis of rotation of the paddle is centrally located in the cylindrical hopper. The drive shaft 24 is driven by a motor as is conventional, but is substantially spaced from the pivot assemblies 30 and 31 which form the pivot axis of the hopper 20. This spacing causes the hopper to pivot as an eccentric about the pivot assemblies 30 and 31 rather than around the mixing paddle's axis as in the prior mixers. A "substantial" space is more than about 12 inches, and is preferably about 15 to 18 inches. The maximum spacing that is preferred is 30 to 40 inches, but this could be larger for a larger machine.

This spacing is advantageous because it allows the apparatus to have a low charge height and a higher dump height. Hoppers that pivot about the axis of rotation of their mixing paddles tend to have lower dump heights than charge heights. By offsetting the axis of rotation of the paddle from the pivot axis, a tremendous advantage is obtained.

By substantially spacing the drive shaft 24 from the pivot assemblies 30 and 31, the hopper 20, when extended upward by actuating the prime movers 34 and 35, hinges about the pivot assemblies 30 and 31 and the center of gravity of the hopper and its contents follows an arcuate path. This eccentric motion is only possible with a substantial space between the pivot axis and the paddle's axis of rotation. The eccentric motion of the hopper 20, which is the result of the offset axes, allows for a comparable or lower charge height than the dump height, making the apparatus more ergonomically suitable. Having a charge height that is close to or lower than the dump height is advantageous to the operator because it allows the operator to load the inner chamber 26 at approximately waist height. Loading the inner chamber 26 from waist height, below the point of discharge, substantially decreases the risk of injury and fatigue to the operator. An operator only has to lift bags of mortar or shovel sand to waist height, a more appropriate height for this type of work.

The grated mixing gate 95 extends over the opening of the hopper 20 to protect the operator from coming into contact with the mixing paddle 22 while loading the chamber 26, as is conventional. The opposing blades of the mixing paddle 22 are conventional. The gate 95 is rigidly attached to at least one top portion of the hopper chamber opening and connected to the pivot assembly 31 via a grating opener bar 94. The grating opener bar 94 allows the bottom portion of the gate 95 to open during dumping. The hopper 20, in the preferred embodiment, has a capacity of approximately 14 to 20 cubic feet, but this can be varied greatly, as will be understood by the skilled artisan.

The preferred frame 10 of the apparatus, to which the hopper 20 is pivotably mounted, is substantially rectangular and includes at least one arm and three legs to support it. Of course, any other frame shape is possible as an alternative. In the preferred embodiment, there are two arm and leg combinations, and two separate legs, each mounted to a different corner of the frame 10. The arms 46 and 66 are adjustably mounted to the frame 10 by being inserted telescopically into corresponding receivers 48 and 68, respectively. The receiver 48, which is welded to the frame 10, permits substantially horizontal, linear displacement of the arm 46 relative to the frame 10 and permits locking of the arm 46 to the receiver 48. The arm 66 is attached in the receiver 68 in essentially the same way as the arm 46, and the receiver 68 is preferably welded to the frame 10. The arms 46 and 66 are moved horizontally to the desired positions and held in place by sliding hitch pins 58 through aligned holes 56 in the receivers and holes 52 in the arms, and securing the hitch pins in place with linch pins 59 during dumping. The base of the apparatus must be wide enough to support the higher and laterally offset center of gravity to prevent tipping during dumping. The horizontally adjustable arms accomplish this by effectively increasing the size of the base beneath the apparatus.

The arms 46 and 66 are defined by at least one square cylindrical sidewall in the preferred embodiment. However, the sidewall could be any other shape including a circular cylindrical sidewall. The receiving channels 48 and 68 of the frame 10 in the preferred embodiment are placed at an angle relative to one another of about ninety degrees. The receiving channels 48 and 68 could, of course, be at an acute or obtuse angle. Thus, when the arms 46 and 66 are extended or further inserted, not only is the frame's effective width changed but so is its effective length. The arms therefore can create a longer and wider, and thus a more stable, base for the frame and hopper. This configuration allows the operator to adjust the length and width of the frame from a smaller effective base to a wider effective base for stability when the hopper 20 is fully extended by the prime movers 34 and 35.

The legs 42 and 62 are also mounted into receivers 44 and 64 that are mounted to the outer edges of the respective arms 46 and 66. The arms are thus interposed between the frame 10 and the legs 42 and 62. The legs 72 and 82 are mounted in the receivers 74 and 84 that are preferably welded to the frame 10 near the corners opposite the legs 42 and 62. The legs 42, 62, 72 and 82 are displaceable vertically through the respective receivers to a desired height and are therefore adjustable. This structure eliminates having to put the apparatus up on blocks to get the hopper to its desired dumping height and is much safer due to the lower likelihood of the apparatus becoming unstable than when placed on blocks. The leg receivers do not have to permit vertical displacement, but it is preferred that they do.

Once the desired height is established, the operator secures the legs at that height by placing different hitch pins 58 through the aligned holes 54 of the receivers and holes 50 of the legs, and then secures the hitch pins 58 in place by using linch pins 59. The legs 42, 62, 72 and 82 are typically adjusted to an equal height, but to accommodate an uneven work area the legs can be set at different heights. This allows the operator to work in a sand pit or other uneven ground without the fear of the apparatus tipping over. Of course, adjustments of the height by adjusting the legs 42, 62, 72 and 82 affect the minimum and maximum charge and dump heights described above.

Each leg 42, 62, 72 and 82 terminates in a foot 40, 60, 70 and 80, respectively, that seats against the surface upon which the apparatus rests such as the soil of the work site. The foot is typically square in shape and flat so it does not sink into the work surface more than an acceptable amount. However, the foot may be adapted to take any reasonable form such as a circular flat metal plate, or the end of the leg without an attachment or a hemisphere. This eliminates the problem in the prior art of burying tires in the sand or having a flat tire, since the apparatus is not wheeled.

The frame 10 has at least two channels 13 and 14 for accepting the forks of a standard forklift. In the preferred embodiment, there are four receiving channels 11, 12, 13 and 14 into which the forks can be inserted from each of four sides of the rectangular frame 10. These channels are used for maneuvering the mixing apparatus around the work site with a fork lift. The apparatus also fits in a standard eight-foot truck bed when collapsed, thereby making transportation of the apparatus from one worksite to another very easy. Since the apparatus does not have a wheeled base as in the prior art, there is a decreased risk of theft of the apparatus.

To begin using the mixing apparatus at a job site, an operator inserts the forks of a forklift into the receiving channels 11 and 12. The forklift operator then lifts the mixing apparatus and transports the apparatus to the desired location on the work site. Once in the desired location, the operator adjusts the arms 46 and 66 to the desired length by sliding the arms 46 and 66 within the corresponding receivers 48 and 68 and securing the arms in place with hitch pins 58. After the base's length and width have been set, the operator adjusts the legs 42, 62, 72 and 82 within the corresponding receivers 44, 64, 74 and 84 to the desired height and secures each leg with a hitch pin 58. Of course, these steps could be reversed. The mixing apparatus is then lowered to rest on the surface of the desired location; adjustments may be made at this time to compensate for an uneven work area.

Once the mixing apparatus is in place, the operator can move the hopper 20 to the desired charge height using the prime mover controls 91 and 92. This may require elongating the prime movers 34 and 35 or shortening the prime movers 34 and 35 slightly to reach the desired height, but ordinarily the hopper 20 will be set at its lowest position for charging. The operator will then fill the inner chamber 26 with the necessary ingredients to create the desired slurry. The operator may fill the chamber 26 using bags of mortar or cement, which are broken onto the grate 95 covering the mixing paddles 22 or by shoveling sand into the chamber 26 from a sand pit or both. Water is also added to the hopper 20.

The mixing paddles 22 mix the ingredients to the desired degree. Once mixing has been completed, the operator can use the hydraulic controls 91 and 92 to elongate the prime movers 34 and 35 to begin dumping the slurry. The legs 42, 62, 72 and 82 and arms 46 and 66 can be adjusted prior to dumping and after filling to accommodate a shorter or taller receptacle. During dumping, the slurry is emptied into either another apparatus for transport within the site or dumped directly into the desired work area, such as a concrete form. The operator then shortens the prime movers 34 and 35 to lower the hopper 20.

The adjustability of the arms 46 and 66 and legs 42, 62, 72, and 82 also enables the mixing apparatus to be used under a mixing tower. The forklift operator can place the apparatus under the mixing tower, and the legs 42, 62, 72, and 82 and arms 46 and 66 are then adjusted to widen and lengthen the base as needed. The legs 42, 62, 72, and 82 can be moved vertically to position the hopper at a height that allows the appropriate distance below the discharge port of the tower. The arms 46 and 66 can be adjusted horizontally to a length that is outside the frame of the tower to form a wider base that enables the operator to dump the mixer at a higher height than a typical mixer would allow. The extended arms 46 and 66 provide an extra wide base to support the shifted weight of the hopper to one side and prevent the entire apparatus from toppling over.

The horizontally adjustable arms 46 and 66 and vertically adjustable legs 42, 62, 72, and 82 enable the operator to adapt the apparatus to the work site. If the operator is filling the inner chamber 26 using an on-site mixing tower, the legs can be adjusted to the necessary height without the need for separate leg extensions or blocks. The operator can also adjust the height of the apparatus to accommodate his or her desired load height while loading by hand. This is especially helpful because the height of the apparatus being used to transport the material after it is mixed varies depending on the type of job and the application being used. Various applications may be further aided by permitting the discharge height to vary.

The frame 10 has a removably mounted motor housing 96 mounted adjacent the hopper 20. The housing 96 protects the motor and the battery 93, and houses the controls 91 and 92 for the prime movers 34 and 35. Directly below the motor housing 96 is the hydraulic tank 90, which contains hydraulic fluid for the prime movers 34 and 35.

There are many advantages to the claimed mixing apparatus. One advantage is the ability to have a low charge height and a higher dump height. The hopper's pivot axis and the paddle's axis of rotation are spaced apart significantly enough to create a low charge height and a higher dump height. By spacing the two axes, the hopper is extended upward via the prime movers while hinging about the pivot axis in the manner of an eccentric. This rotation creates a comparable or lower charge-height than the dump height, giving the apparatus a safer design. The ability to change the length of the arms and height of the legs of the mixing apparatus gives the apparatus a stable base to accommodate the offset hopper and permits adjustments for dumping into containers and forms of various heights. When the arms are fully extended the mixing apparatus stands approximately eight feet long by six feet wide. By creating a wider base, the invention has a lower risk of the hopper tipping over during loading or, especially, during dumping.

Unlike conventional mixers, which have to be cleaned by bending over and spraying or scrubbing the mixer, which can cause injury to the operator over time, the claimed invention lifts and rotates the hopper so that the hopper is turned on its side at the operator's standing height during cleaning. The operator can easily clean the mixing apparatus while in an upright position.

Figure 5:
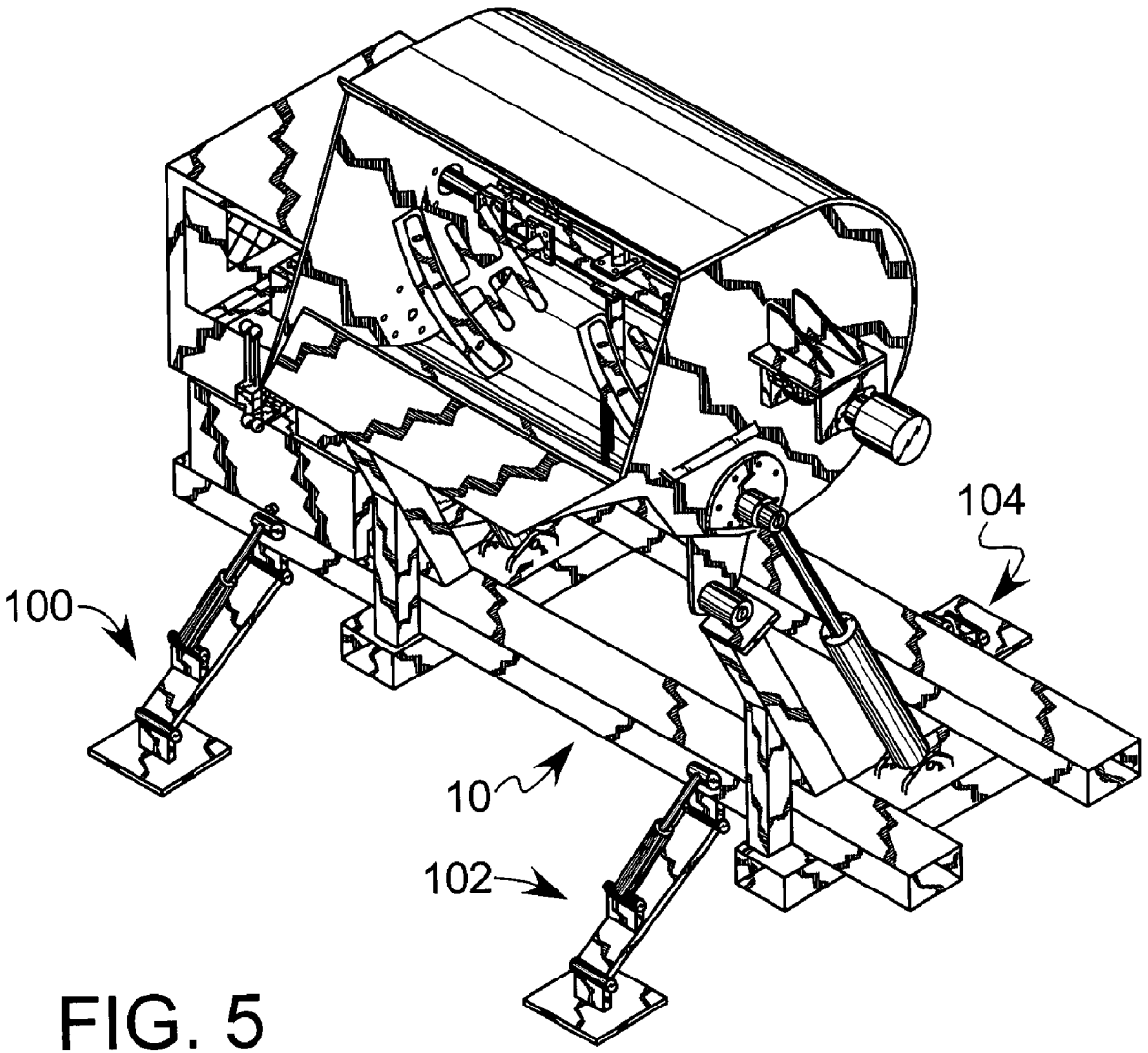
FIG. 5 is a view in perspective illustrating an alternative to the present invention.

One alternative to the preferred embodiment is shown in FIG. 5, having at least three arms, legs and foot combinations that form outriggers 100, 102 and 104, which are not unlike conventional hydraulic outriggers as are found on backhoe loaders, for example. Two outriggers 100 and 102 are attached to the frame 10 on the front of the apparatus with the third outrigger 104 attached on the back frame 10 portion of the apparatus. This arrangement could be reversed, of course, having one outrigger on the front portion of the apparatus and two outriggers on the back portion of the apparatus. Alternatively, there could be four outriggers, one near each corner of the frame. The outriggers 100, 102 and 104 function like conventional outriggers and are moved by hydraulic rams that are controlled in a conventional manner to pivot the hinged arms up and down. The outriggers 100, 102 and 104 can be articulated horizontally, vertically and laterally to vary the effective length, width and height of the base of the mixing apparatus. This embodiment shows a variation on the preferred passive base of the frame shown in FIG. 1.

Figure 6:
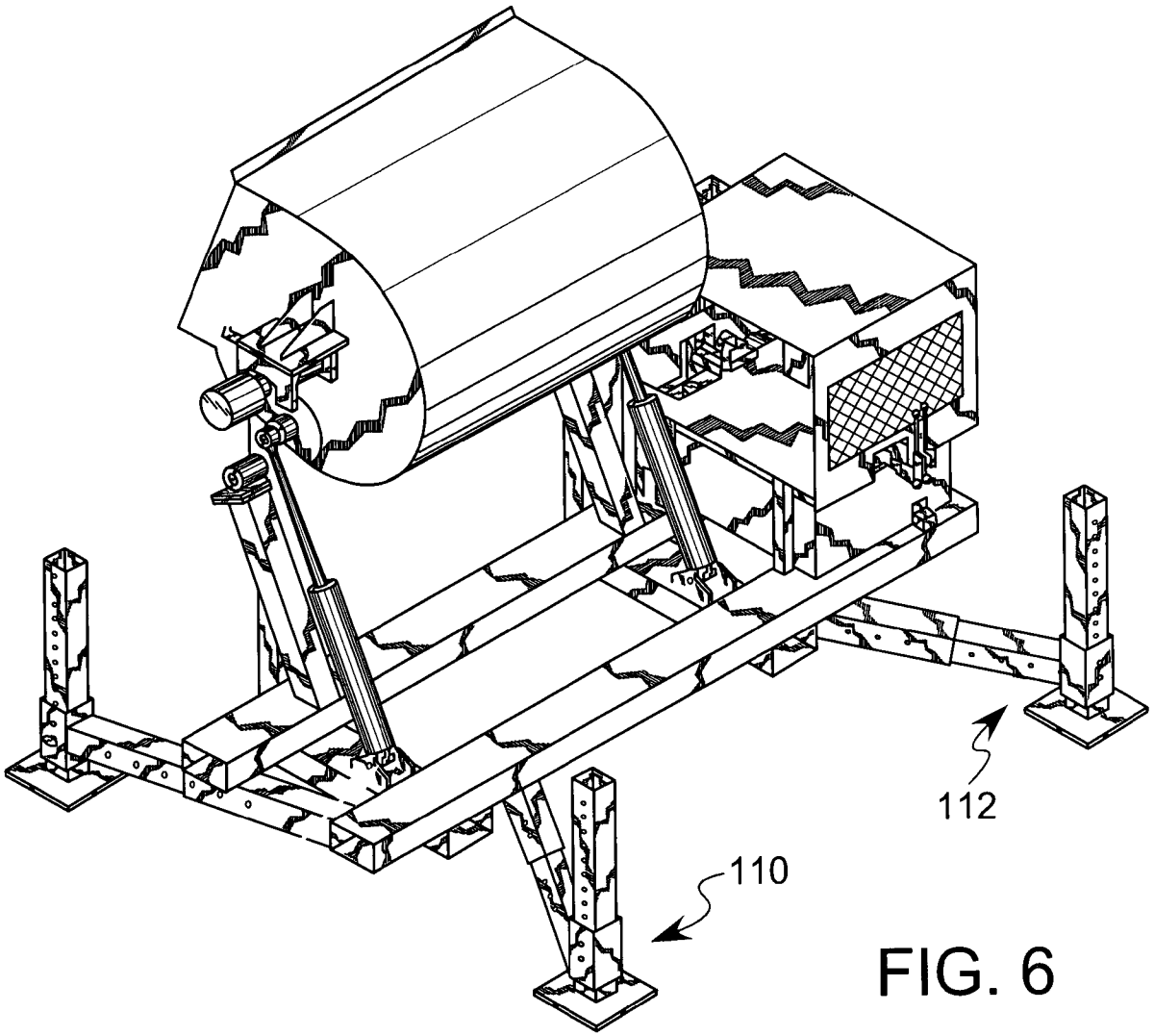
FIG. 6 is a rear view in perspective illustrating an alternative to the present invention.

Another alternative to the preferred embodiment is shown in FIG. 6. The mixing apparatus has four arms, each angled relative to the other. All arms elongate at an angle for even greater width and stability. This is unlike the preferred embodiment that has only two arms on one side of the frame 10. The additional arms permit one to increase the effective length and width of the base, which may be desirable for a larger apparatus but is not essential for the preferred embodiment due to the fact that the shifting of the center of gravity of the machine is only to one side.

While certain preferred embodiments of the present invention have been disclosed in detail, it is to be understood that various modifications may be adopted without departing from the spirit of the invention or scope of the following claims.

The invention claimed is:

1. A slurry mixing apparatus comprising:

a. a frame having a plurality of non-wheeled, stationary feet that rest upon the ground;

b. a hopper pivotably mounted to the frame on a single pivot axis that allows the hopper to pivot through a single path, the hopper having a chamber with an opening for receiving slurry material and wherein a rotatable mixing paddle in the hopper chamber has an axis of rotation spaced from the pivot axis a distance greater than a radius of the mixing paddle, wherein said single pivot axis is fixed relative to the frame; and c. at least one linear prime mover mounted to the frame at a first end and to the hopper at an opposite, second end, wherein the second end of the prime mover is spaced from the pivot axis to form a moment arm; where the hopper is adapted to rotate about the pivot axis when the prime mover is actuated after the frame is fixed relative to the feet and relative to the ground, wherein the single pivot axis is positioned within a stable base defined by the plurality of non-wheeled feed for preventing the frame from toppling over when said prime mover is fully extended and the hopper rotates about the pivot axis.

2. A slurry mixing apparatus in accordance with claim 1, further comprising a second prime mover mounted to the frame and the hopper.

3. A slurry mixing apparatus in accordance with claim 2, wherein the prime movers are hydraulic rams.

* * * * *

UNITED STATES PATENT AND TRADEMARK OFFICE

CERTIFICATE OF CORRECTION

PATENT NO. : 7,165,877 B2
APPLICATION NO. : 10/449470
DATED : January 23, 2007
INVENTOR(S) : Damian L. Lang It is certified that error appears in the above-identified patent and that said Letters Patent is hereby corrected as shown below:

Claim 1, line 45, add --feet--, delete "feed"

Signed and Sealed this

Third Day of April, 2007

JON W. DUDAS
*Director of the United States Patent and Trademark Office*